United States Patent [19]

Kochan

[11] Patent Number: 4,556,217

[45] Date of Patent: Dec. 3, 1985

[54] PHYSICAL EXERCISER

[76] Inventor: Branislav R. Kochan, #5, 2368 Millbourne Rd. W., Edmonton, Alberta, Canada, T6K 3B4

[21] Appl. No.: 569,893

[22] Filed: Jan. 11, 1984

[51] Int. Cl.[4] ..... A63B 21/02

[52] U.S. Cl. ..... 272/141; 272/137

[58] Field of Search ..... 272/137, 130, 68, 141, 272/142, DIG. 5

[56] References Cited

U.S. PATENT DOCUMENTS

| | | | |
|---|---|---|---|
| 843,291 | 2/1907 | Mullins | 272/68 |
| 1,395,313 | 11/1921 | Trepanier | 272/68 |
| 2,634,976 | 4/1953 | Mock | 272/68 |
| 3,738,651 | 6/1973 | Norman et al. | 272/141 |
| 4,239,212 | 12/1980 | Hickey | 272/141 |

*Primary Examiner*—Richard J. Apley
*Assistant Examiner*—James Prizant
*Attorney, Agent, or Firm*—Ernest P. Johnson

[57] ABSTRACT

A physical exerciser is provided which utilizes a pair of compression springs. The springs are maintained in a spaced apart, parallel, side-by-side, straight state by an assembly comprising an inner guide member and an outer tube circumscribing said member. The springs extend longitudinally in troughs formed in the peripheral surface of the elongate guide member. The troughs extend parallel to the longitudinal axis of the tube. The tube holds the springs in place in the troughs. The assembly further provides a stop at one end of each spring, to fix that end against displacement. A pair of tubular handles are mounted on the tube, one at each of the tube's ends. Each handle includes a pin extending transversely across the free end of one of the springs. Suitable slots are provided in each end of the guide member and tube, so as to allow the handles to slide inwardly, each such handle acting to compress one of the springs. There are thus duplicate means at work in the single tube—each means comprises a spring, its stop, the handle and pin which can compress the spring, and the slots which permit the pin to travel. The spring, pin and slots of each means lie in a common plane. The two common planes for the two means are disposed at 90° to each other. The exerciser thus has two handles, each operating independently against its own spring, which may be forced inwardly simultaneously and be brought close together, for better muscle development.

3 Claims, 10 Drawing Figures

PHYSICAL EXERCISER

BACKGROUND OF THE INVENTION

1. Field of the Invention

The invention relates to a physical exerciser. More particularly, it relates to an exerciser of the type wherein manual pressure is exerted, to compress a set of springs, so as to exercise certain groups of muscles of the human body.

2. Prior Art

Physical exercisers of the compression spring type are readily available commercially. Such devices usually involve providing a spring extending longitudinally within a pair of telescoping cylinders. This spring may be compressed by sliding the cylinders together. This compressing action involves the muscles performing work.

These exercisers are sometimes combined with an endless rope assembly, so as to provide a dual purpose push-pull physical exercising device.

Exemplary of this type of prior art device is that disclosed in U.S. Pat. No. 4,290,600 issued to G. F. Kolbel. Therein is described an exerciser comprising a central tube. A pair of end tubes, each having a handle at its outer end, a slidably and telescopically mounted on the ends of the central tube. A single spring, which extends the full length of the assembly, is positioned to extend through and beyond the ends of the central tube. The end tubes contain the spring ends and can be moved inwardly along the central tube, against the resistance of the spring.

U.S. Pat. Nos. 3,741,539, 3,343,837, 3,759,514 and 3,268,225, further exemplify compression spring-type exercisers.

However, these prior art devices suffer two common disadvantages, namely: (a) the excessive length of the unit; and (b) the limited range of motion permitted, which prevents the outstretched arms from being brought close together. These drawbacks arise from the limitations of the mechanical properties of the spring. Prevention of spring failure by fatigue and preservation of spring resilience dictate that the maximum permissible compression of the spring should be restricted to about one-third the length thereof. Thus, to provide a full range of motion for exercising, most particularly the muscles of the upper torso, spring size requirements have, heretofore, resulted in a device having a length which extends beyond the width of the human body. The arms, therefore, are overextended at the commencement of the compression movement. Further, the range of sliding handle movement along the length of the tube is limited to one-third the length of the spring, thereby preventing bringing the arms closely together at a central anterior position.

Ideally, muscular exercise requires that the muscle be permitted to contract over a substantial range of its potential movement. In addition, the load exerted on the muscle during its contraction should be sustained, or increased incrementally, throughout its range of movement. The prior art, compression spring devices fall short in meeting these requirements.

There is, therefore a need for such a device characterized by the following features:

a length more proportional to the width of the human body;

sliding handles which may be brought more closely together adjacent the longitudinal mid-point of the device; and an arrangement wherein the spring resistance action is substantially consistent throughout the compressive movement.

SUMMARY OF THE INVENTION

In accordance with the simplest form of the present invention, a pair of compression springs are utilized. These springs are maintained in parallel, spaced-apart, side-by-side, straight condition by an assembly comprising an outer tubular member (tube) and an inner guide member. The guide member is elongate and extends substantially the length of the tube. It defines or forms longitudinally extending, peripheral passageways or troughs in which the springs lay. The tube snugly encapsulates or surrounds the springs and retains them in the desired condition in the passageways. Each spring is restrained or retained at one end against longitudinal displacement by a stop means associated with the tube and guide assembly. The two stop means thus involved are positioned one at each end of the tube and guide assembly. At the non-restrained end of each spring, a sliding assembly is provided. These two sliding assemblies each comprise a tubular handle member, which is slidably mounted on the tube, and an attached member (such as a pin) which extends transverse to the longitudinal axis of the tube and bears against the end of the spring to be compressed. An arrangement of slots, provided in the tube and guide assembly, permits of inward sliding movement of the two sliding assemblies. Suitable retaining means are provided on the tube and guide assembly to prevent the sliding assemblies from coming off the ends of the tube.

There are thus two duplicate mechanisms at work in the single tube. Each mechanism comprises a spring, a restraining stop means, and a transverse pin moving along the length of the tube to compress the spring. The spring, the pin, and the slot means which permit the pin to move, are all in a common plane. As there are two of these mechanisms and it is required that they operate independently, the two common planes are angularly disposed, preferably at about 90° to each other.

As a result of incorporating this arrangement, there is provided an exerciser which, in its basic form, comprises two sliding handle members which can each be moved inwardly simultaneously, perferably each about $\frac{1}{3}$ of the length of the spring against which it acts. Thus the arms of the user can move inwardly, against resistance, about $\frac{2}{3}$ of their original spacing, without unduly stressing the springs. The exerciser is also shorter than the prior art exercisers known to me. More particularly, its length can be about the width of the user's shoulders. The shorter length of the exerciser and its capacity to permit the user's hands to come close together, together improve the effectiveness of the device in use.

In a preferred form, the exerciser comprises two pairs of diametrically arranged springs, to provide a balanced unit which is less likely to bind, as compared to the two-spring version.

Broadly stated, the invention is a physical exerciser comprising: two pairs of elongate compression springs; a first assembly comprising an elongate guide member and an elongate tubular member adapted to circumscribe the guide member; said inner guide member forming two pairs of peripheral, longitudinal extending passageways, each such pair of passageways lieing in a common plane, said planes being angularly disposed one to the other; said first assembly being adapted to receive and retain the springs, one in each of the passageways, whereby each pair of springs is maintained by said assembly in parallel, spaced-apart, coplanar, side-by-side, straight condition; a first stop means, connectable to the first assembly at one of its ends, for preventing longitudinal displacement of the adjacent ends of one pair of springs; a second stop means, connectable to the first assembly at the other of its ends, for preventing longitudinal displacement of the adjacent ends of the other pair of springs; a pair of handle member assemblies mountable on the tubular member for sliding movement thereon, one handle member assembly being positionable at each end of the tubular member; each said handle member assembly comprising third means for bearing against the free ends of one pair of springs; said first assembly forming longitudinally extending slots at each of its ends through which the third means may extend, whereby the handle member assemblies may be moved inwardly toward each other along the tubular member to simultaneously compress the two pairs of springs; and means, connectable with the first assembly, for retaining the handle member assemblies on the tubular member.

DESCRIPTION OF THE DRAWINGS

FIG. 2(*a*) is a sectional view taken at the line B—B in FIG. 1;

FIG. 3(*a*) is a top plan view of the outer tube taken substantially along line a—a in FIG. 3;

FIG. 3(*b*) is a left hand end view of the outer tube;

FIG. 4(*b*) is a left hand end view of the guide; and

DESCRIPTION OF THE PREFERRED EMBODIMENT

The exerciser comprises a substantially rigid, elongate, tubular member 1. This tubular member 1 is referred to hereafter as the outer tube 1.

Figure 3:
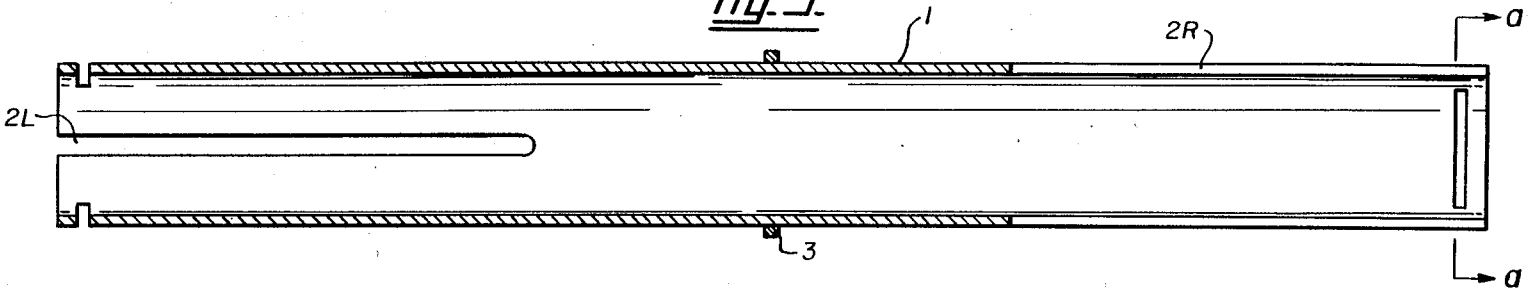
FIG. 3 is a sectional side view of the outer tube.
Figure 3A:
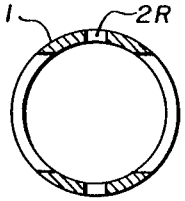
Figure 3B:
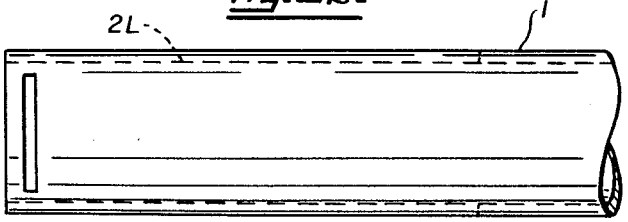
Figure 4A:
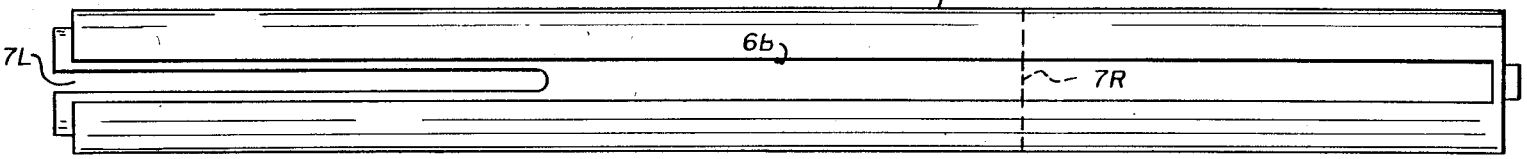
FIG. 4(*a*) is a side view of the guide.
Figure 4B:
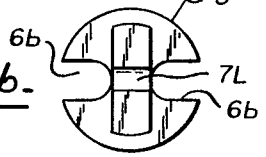
Figure 5A:
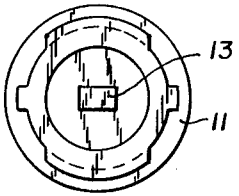
FIGS. 5(*a*) and 5(*b*) are side and end views, respectively of the retainer plate.
Figure 5B:
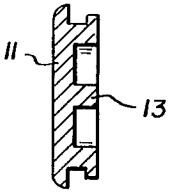

As shown in FIGS. 3, 3*a*, 3*b* the outer tube 1 defines two pairs of diametrically opposed first slots 2L, 2R. One such pair of slots 2L is located at the left end of the outer tube 1 and the other pair of slots 2R is located at the right end. Each such pair of slots extends inwardly from the tube end, part way to the longitudinal mid-point of the tube. It will be noted that each pair of slots lies in a common plane and the two planes are disposed perpendicularly to each other.

A ring 3 circumscribes the outer tube 1 at its longitudinal mid-point and is affixed thereto. This ring 3 functions as a stop, to limit the inward travel of the sliding handle members 4, as further described below.

Figure 1:
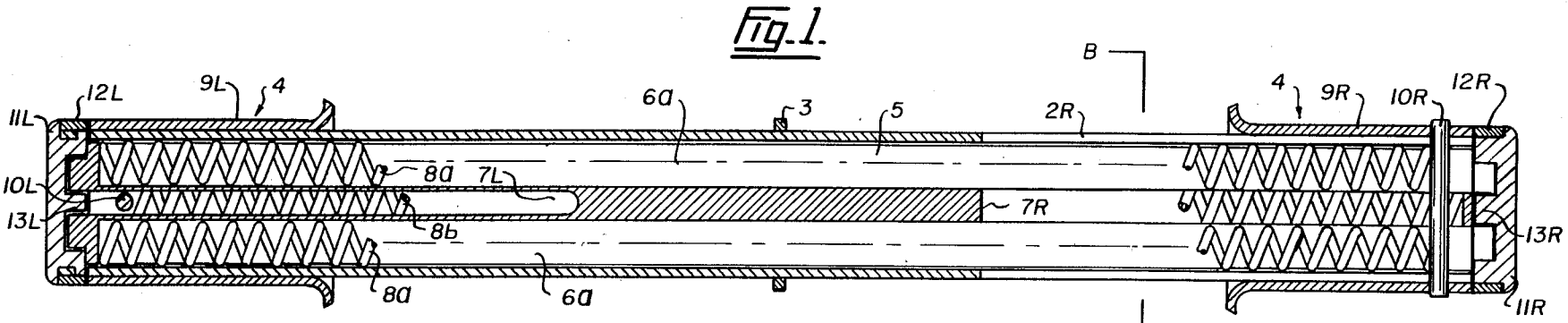
FIG. 1 is a sectional side view of the physical exerciser fully assembled in the relaxed position.
Figure 2:
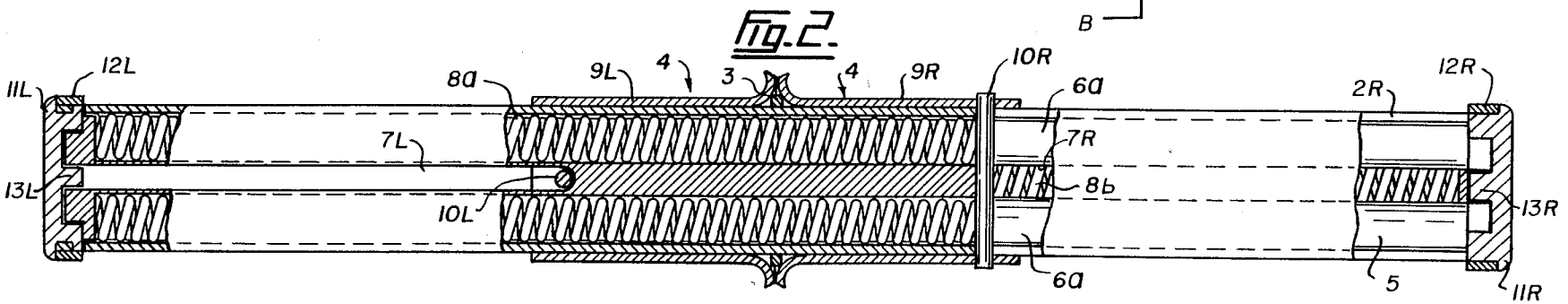
FIG. 2 is a side view, partly in section, of the exerciser in the fully compressed postion.
Figure 2A:
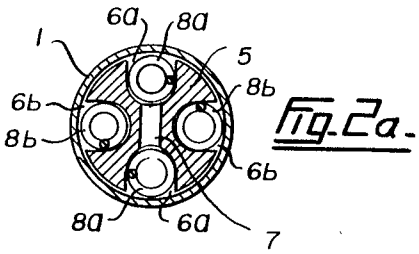

A guide member 5 is positioned within the outer tube 1 and extends substantially the length of said tube. As shown in FIGS. 2(*a*) and 4(*b*), the guide member 5 is generally cruciform in section and defines two pairs of semi-circular, peripheral troughs or passageways 6(*a*), 6(*b*) which extend along its length. The passageways of each pair are positioned on opposte sides of the guide member 5, and thus lie in a common plane.

The guide member 5 further defines two second slots 7L and 7R. Each such second slot extends inwardly from one end of the guide member 5, part way to its longitudinal mid-point. The two second slots 7L, 7R lie in planes perpendicular to each other.

It will be noted that the outer tube first slots 2R, the guide member second slot 7R, and the peripheral passageways 6(*a*) all lie in a first common plane. The outer tube first slots 2L, the guide member second slot 7L, and the peripheral passageways 6 (*b*) all lie in a second common plane, which is perpendicular to said first plane.

A compression spring 8 is positioned in each of the peripheral passageways 6(*a*) , 6(*b*) and extends substantially the entire length of each such passageway.

A pair of handle member assemblies 9R, 9L are mounted on the outer tube 1, one at each end thereof, for sliding movement thereon. The right end handle member assembly 9R comprises a tubular handle member 4 and a diametrically extending, internal pin 10R. The pin 10R is secured to the handle member 4R. In the same fashion, the left end handle member assembly 9L comprises a tubular handle member 4L and an internal pin 10L.

The pin 10R extends through the outer tube slots 2R and the guide member second slot 7R and bears against the ends of one pair of spirngs 8*a*. Similarly, the pin 10L extends through the outer tube slots 2L and the second slot 7L and bears against the ends of the other pair of springs 8*b*.

A pair of transverse stops 11R, 11L are secured to the tube 1, one at each of its ends. The stop 11R bears against the right ends of the springs 8*b* and functions to resist longitudinal displacement of said spring. Similarly, the stop 11L bears against the left ends of the springs 8*a* and functions to resist longitudinal displacement thereof. A central rib 13R, provided on stop 11R, fits into guide member slot 7R and functions to resist rotational displacement thereof. In the same fashion, a central rib 13L, provided on stop 11L, fits into guide member slot 7L and functions to resist rotational displacement thereof.

A pair of transverse retainer plates 12R, 12L are detachably secured to the tube 1 and function to prevent the handle members 4R, 4L from slipping off the tube 1.

In summary, it is seen that the exerciser comprises a stationary assembly, consisting of the tube 1, the guide member 5, and the stops 11R, 11L. The guide member 5 functions to maintain each pair of the compression springs 8, 8*b* in a parallel, spaced-apart, side-by-side, coplanar straight condition. The tube 1 functions to contain the springs in the passageways of the guide member 5 and thus also cooperates in holding the springs straight. The stops 11R, 11L each function to fix the ends of one pair of the springs, to prevent longitudinal displacement thereof. There is then provided the pair of sliding handle member assemblies 9R, 9L which each function to compress one pair of springs against the pertinent stop. The end result is that, in the single exerciser, there is provided two sliding handle members which each act against the resistance of a separate spring system and which can therefore be brought close together in use.

The invention has been described in the preferred context of four springs acting as two independent pairs in combination with two sliding handle members. One could also use a number of springs greater than four.

Such modifications are within the scope of the invention.

It is also contemplated that one could use two tubes and interconnect their handle members, to provide a more resistive device.

Finally, for purposes of this specification, it is to be understood that the word "spring", stated in the singular in the claims, is intended to read on a plurality of springs laid end to end.

The embodiments of the invention in which an exclusive property or privilege is claimed are defined as follows:

1. A physical exerciser comprising:

a tubular member, each end of said member forming a pair of opposed first slots extending longitudinally of said member, said pairs of first slots lying in planes angularly disposed, one to the other;

a guide member adapted to be disposed within the tubular member and to extend substantially the latter's length, each end of said guide member forming a second slot extending longitudinally of said guide member and being in the plane of the adjacent pair of first slots, said guide member forming two pairs of peripheral passageways extending longitudinally along its length, one such pair of passageways being in the plane of one second slot, the other such pair of passageways being in the plane of the other second slot;

two pairs of compression springs which may be positioned in the passageways;

a pair of tubular handle members adapted to be slidably mounted on the tubular member, one of each end thereof;

a pair of pins, each being connectable with a handle member, so as to extend transversely through one pair of first slots and the adjacent second slot, whereby movement of the handle member inwardly on the tubular member will cause the pin to press against the ends of the pair of springs in the passageways aligned with said second slot, thereby to compress said springs;

a first step means, connectable to the tubular member at one of its ends, for preventing longitudinal displacement of the adjacent ends of one pair of springs;

a second stop means, connectable to the tubular member at the other of its ends, for preventing longitudinal displacement of the adjacent ends of the other pair of springs;

and means for retaining the handle members on the tubular member;

whereby the tubular and guide members combine to maintain each pair of springs in parallel, spaced-apart, side-by-side, coplanar, straight condition and the handle members may be simultaneously forced toward the mid-point of the tubular member, each such handle member being operative to compress only the pair of springs against which its pin bears.

2. A physical exerciser comprising:

a tubular member, each end of said member forming a pair of opposed first slots extending longitudinally of said member, said pairs of first slots lying in planes angularly disposed, one to the other;

a guide member disposed within the tubular member and extending substantially the latter's length, each end of said guide member forming a second slot extending longitudinally of said guide member and being in the plane of the adjacent pair of first slots, said guide member forming two pairs of peripheral passageways extending longitudinally along its length, one such pair of passageways being in the plane of one second slot, the other such pair of passageways being in the plane of the other second slot;

a compression spring disposed in each passageway and extending substantially its length;

a pair of tubular handle members slidably mounted on the tubular member, one at each end thereof;

a pair of pins, each being connected with a handle member and extending transversely through one pair of first slots and the adjacent second slot, whereby movement of the handle member will cause the pin to press against the ends of the pair of springs in the passageways aligned with said second slot thereby to compress said springs;

a first stop means, connectable to the tubular member at one of its ends, for preventing longitudinal displacement of the adjacent ends of one pair of springs;

a second stop means, connectable to the tubular member at the other of its ends, for preventing longitudinal displacement of the adjacent ends of the other pair of springs;

and means for retaining the handle members on the tubular member;

whereby the tubular and guide members combine to maintain each pair of springs in parallel, spaced-apart, side-by-side, coplanar, straight condition and the handle members may be simultaneously forced toward the mid-point of the tubular member, each such handle member being operative to compress only the pair of springs against which its pin bears.

3. A physical exerciser comprising:

two pairs of elongate compression springs;

a first assembly comprising an elongate guide member and an elongate tubular member adapted to circumscribe the guide member;

said inner guide member forming two pairs of peripheral, longitudinal extending passageways, each such pair of passageways lieing in a common plane, said planes being angularly disposed one to the other;

said first assembly being adapted to receive and retain the springs, one in each of the passageways, whereby each pair of springs is maintained by said assembly in parallel, spaced-apart, coplanar, side-by-side, straight condition;

a first top means, connectable to the first assembly at one of its ends, for preventing longitudinal displacement of the adjacent ends of one pair of springs;

a second stop means, connectable to the first assembly at the other of its ends, for preventing longitudinal displacement of the adjacent ends of the other pair of springs;

a pair of handle member assemblies mountable on the tubular member for sliding movement thereon, one handle member assembly being positionable at each end of the tubular member;

each said handle member assembly comprising third means for bearing against the free ends of one pair of springs;

said first assembly forming longitudinally extending slots at each of its ends through which the third means may extend, whereby the handle member assemblies may be moved inwardly toward each other along the tubular member to simultaneously compress the two pairs of springs;

and means, connectable with the first assembly, for retaining the handle member assemblies on the tubular member.

* * * * *